United States Patent [19]

Wafer et al.

[11] 4,220,934

[45] Sep. 2, 1980

[54] CURRENT LIMITING CIRCUIT BREAKER WITH INTEGRAL MAGNETIC DRIVE DEVICE HOUSING AND CONTACT ARM STOP

[75] Inventors: John A. Wafer, Brighton Township, Beaver County; Robert H. Hill, S. Beaver Township, Beaver County; William I. Stephenson, Jr., Brighton Township, Beaver County, all of Pa.

[73] Assignee: Westinghouse Electric Corp., Pittsburgh, Pa.

[21] Appl. No.: 952,036

[22] Filed: Oct. 16, 1978

[51] Int. Cl.[2] ..... H01H 77/10

[52] U.S. Cl. ..... 335/16; 335/195

[58] Field of Search ..... 335/16, 147, 195

[56] References Cited

U.S. PATENT DOCUMENTS

| | | | |
|---|---|---|---|
| 3,815,059 | 6/1974 | Spoelman | 335/195 |
| 4,056,798 | 11/1977 | Malick | 335/195 |
| 4,077,025 | 2/1978 | Slade et al. | 335/16 |

*Primary Examiner*—Harold Broome

*Attorney, Agent, or Firm*—Robert E. Converse, Jr.

[57] ABSTRACT

A current limiting circuit interrupter comprises a molded case, separable contacts disposed in the case, the contact arms supporting one of the contacts, an operating mechanism connected to the contact arm to move the arm between open and closed positions, and a slotted magnetic drive device generating electrodynamic force on the contact arm during extreme overcurrent conditions to rapidly separate the contacts. The magnetic drive device includes a molded housing forming a slot having insulated walls disposed about the contact arm, and a stack of U-shaped laminations of magnetic material fitted into the housing. The space between opposing walls of the housing is slightly less than the thickness of the lamination stack so that the laminations may be snugly press-fitted into the housing. The housing is then secured to the case in such a manner that the laminations are captured and securely positioned without the need for rivets or other fastening means extending through the lamination stack. The housing also includes molded recesses for receiving a compression spring to produce contact force when the contacts are in the closed position, and a molded stop member to limit the movement of the contact arm when the breaker is in the open position.

6 Claims, 4 Drawing Figures

CURRENT LIMITING CIRCUIT BREAKER WITH INTEGRAL MAGNETIC DRIVE DEVICE HOUSING AND CONTACT ARM STOP

CROSS-REFERENCE TO RELATED APPLICATIONS

The present invention is related to material disclosed in the following copending U.S. patent application, assigned to the assignee of the present invention:

- Ser. No. 952,035, "Current Limiting Circuit Breaker with High Speed Magnetic Trip Device", filed Oct. 16, 1978, by W. E. Beatty and J. A. Wafer;
- Ser. No. 951,941, "Current Limiting Circuit Breaker", filed Oct. 16, 1978, by J. A. Wafer and W. V. Bratkowski;
- Ser. No. 951,938, "Current Limiting Circuit Breaker With Pivoting Contact Arm", filed Oct. 16, 1978, by M. B. Yamat, J. A. Wafer, and W. W. Lang;
- Ser. No. 951,939, "Current Limiting Circuit Breaker With Improved Operating Mechanism", filed Oct. 16, 1978, by M. B. Yamat; and
- Ser. No. 951,940, "Circuit Interrupter With Pivoting Contact Arm Having A Clinch-Type Contact", filed Oct. 16, 1978, by J. A. Wafer and M. B. Yamat.

BACKGROUND OF THE INVENTION

1. Field of the Invention

The invention relates generally to current limiting circuit interrupters and, more particularly, to current limiting circuit interrupters having slotted magnetic drive mechanisms.

2. Description of the Prior Art

Circuit breakers are widely used in industrial, residential, and commercial installations to provide protection against damage due to overcurrent conditions. As the usage of electrical energy has increased, the capacity of sources supplying this electrical energy has increased correspondingly. Therefore, extremely large currents can flow through distribution circuits should a short circuit condition occur. Conventional circuit interrupters under these conditions are incapable of preventing severe damage to apparatus connected downstream from the interrupter.

Current limiting circuit interrupters were developed to provide the degree of protection necessary on circuits connected to power sources capable of supplying very large fault currents. One type of circuit interrupter provides such current limiting action by employing a slotted magnetic drive device to achieve extremely rapid separation of the contacts during short circuit conditions. This action produces an arc voltage across the contacts which quickly approaches the system voltage, thus limiting the current flow between the contacts. Although prior art current limiting circuit interrupters of this type perform well, it would be desirable to provide a circuit breaker exhibiting this performance which is simpler to manufacture in quantity and can be assembled at a lower cost.

SUMMARY OF THE INVENTION

In accordance with a preferred embodiment of the present invention, there is provided a current limiting circuit interrupter comprising a molded case, separable contacts disposed in the case, a contact arm supporting one of said contacts, an operating mechanism connected to the contact arm to move the arm between open and closed positions, and a slotted magnetic drive device for generating electrodynamic force upon the contact arm during extreme overcurrent conditions to rapidly separate the contacts. The magnetic drive device includes a molded housing forming a slot having insulated walls disposed about the contact arm, and a stack of U-shaped laminations of magnetic material fitted into the housing. The housing is secured to the case in such a manner that the laminations are captured and securely positioned without the need for rivets extending through the laminations.

DESCRIPTION OF THE PREFERRED EMBODIMENT

Figure 1:
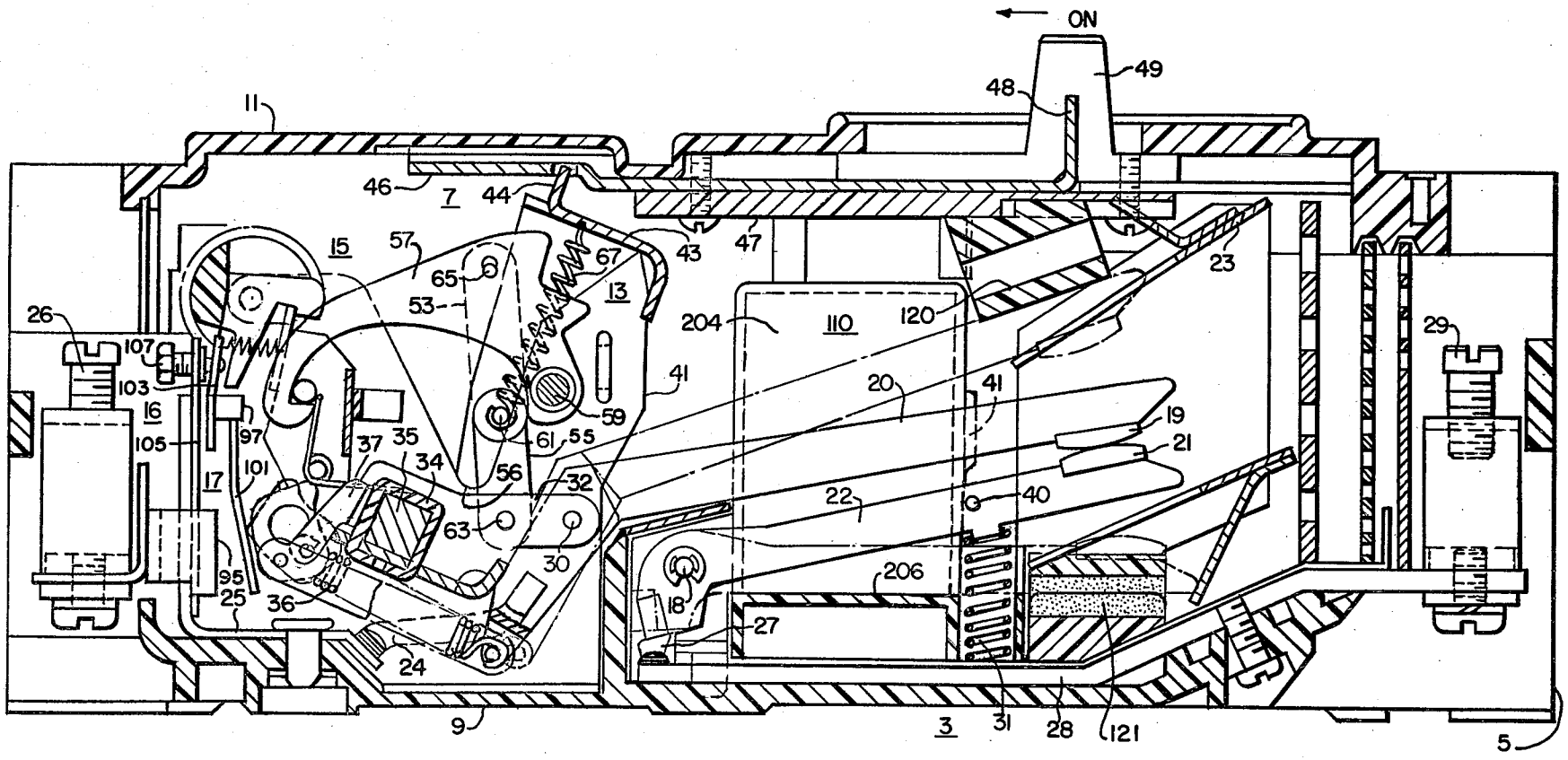
FIG. 1 is a side sectional view of a multipole current limiting circuit interrupter having a slotted magnetic drive device constructed according to the principles of the present invention, the contacts being shown in the closed position.

Referring now to the drawings, in which like reference characters refer to corresponding members, FIG. 1 shows a three pole circuit breaker 3 comprising an insulating housing 5 and a high-speed circuit breaker mechanism 7 supported in the housing 5. The housing 5 comprises an insulating base 9 having a generally planar back, and an insulating front cover 11 secured to the base 9. The housing 5 comprises insulating barriers separating the housing into three adjacent side-by-side pole unit compartments in a manner well known in the art.

The circuit breaker mechanism 7 comprises a single operating mechanism 13 and a single latch mechanism 15 mounted on the center pole unit. The circuit breaker mechanism 7 also comprises a separate thermal trip device 16 and a high-speed electromagnetic trip device 17 in each of the three pole units. The operating mechanism 13 and the high-speed electromagnetic trip device are more completely described in the aforementioned copending U.S. patent application Ser. Nos. 951,941 and 952,035, respectively, and will therefore be only briefly described herein.

A pair of separable contacts 19 and 21 attached to upper and lower pivoting contact arms 20 and 22, respectively, are provided in each pole unit of the breaker. An arc extinguishing unit 23 is also provided in each pole unit. The upper contact 19 is electrically connected, through the upper contact arm 20 which is constructed of conducting material, to a shunt 24 which is in turn connected through a conducting strip 25 and the thermal and magnetic trip devices 16 and 17 to a terminal connector 26. The lower contact 21 is connected through the lower contact arm 22, also constructed of conducting material, through a shunt 27 and conducting strip 28 to a similar terminal connector 29. With the circuit breaker 3 in the closed position as is shown in FIG. 1, an electrical circuit thus exists from the terminal 26 through the conducting strip 25, the shunt 24, the upper contact arm 20, the upper contact 19, the lower contact 21, the lower arm 22, the shunt 27, and the conducting strip 28 to the terminal connector 29.

The upper contact arm 20 is pivotally connected at the point 30 to a rotating carriage 32, which is fixedly secured to an insulating tie bar 35 by a staple 34. A tension spring 36 connected between the left end of the upper contact arm 20 and a bracket 37 attached to the carriage 32 serves to maintain the upper contact arm 20 in the position shown in FIG. 1, with respect to the carriage 32. The upper contact arm 20 and carriage 32 thus rotate as a unit with the crossbar 35 during normal current conditions through the circuit breaker 3.

The single operating mechanism 13 is positioned in the center pole unit of the three pole circuit breaker is supported on a pair of spaced metallic rigid supporting plates 41 that are fixedly secured to the base 9 in the center pole unit of the breaker. An inverted U-shaped operating lever 43 is pivotally supported on the spaced plates 41 with the ends of the legs of the lever 43 positioned in U-shaped notches 56 of the plates 41.

The U-shaped operating lever 43 includes a member 44 extending through a hole in a slide plate 46. The slide plate 46 is slidingly attached to the cover 11 by a support plate 47, and includes a member 48 seated in a molded handle member 49.

The upper contact arm 20 for the center pole unit is operatively connected by means of a toggle comprising an upper toggle link 53 and a lower toggle link 55 to a releasable cradle member 57 that is pivotally supported on the plates 41 by means of a pin 59. The toggle links 53 and 55 are pivotally connected by means of a knee pivot pin 61. The toggle link 55 is pivotally connected to the carriage 32 of the center pole unit by means of a pin 63 and the toggle link 53 is pivotally connected to the releasable cradle member 57 by means of a pin 65. Overcenter operating springs 67 are connected under tension between the knee pivot pin 61 and the bight portion of the operating lever 43. The lower contact arm 22 is pivotally mounted at the point 18 to the base 9.

A compression spring 31 urges the lower contact arm 22 in a counterclockwise direction about the pivot point 18, the counterclockwise travel of the lower contact arm 22 being limited by engagement of a pin 40 with a stop member 41. Since the clockwise force upon the upper arm 20 in the closed position is greater than the counterclockwise force on the lower arm 22, a degree of overtravel is provided from the first point of contact between the arms until the fully closed position. This allows for the effect of contact wear.

The contacts 19 and 21 are manually opened by movement of the handle 49 in a leftward direction as seen in FIG. 1 from the ON position to the OFF position. This movement causes the slide plate 46 to rotate the operating lever 43 in a counterclockwise direction. The rotating movement of the operating lever carries the line of action of the overcenter operating springs 67 to the left causing collapse, to the left, of the toggle linkage 53, 55 to thereby rotate the crossbar 35 in a counterclockwise direction to simultaneously move the upper contact arms 20 of the three pole units to the open position, opening the contacts of the three pole units. The contact arm 20 is then in the position shown in dashed lines in FIG. 1.

The contacts are manually closed by reverse movement of the handle 49 from the OFF to the ON position, which movement moves the line of action of the overcenter springs 67 to the right to move the toggle linkage 53, 55 to the position shown in FIG. 1. This movement rotates the crossbar 35 in a clockwise direction to move the upper contact arms 19 of the three pole units to the closed position.

The releasable cradle 57 is latched in the position shown in FIG. 1 by means of the latch mechanism 15, the construction and operation of which are more completely described in the aforementioned U.S. patent application Ser. No. 951,941.

There is a separate high-speed electromagnetic trip device 17 in each pole unit. Each of the electromagnetic trip devices 17 comprises a generally U-shaped pole piece 95, the legs of which extend around the conducting member 25. An armature structure 97 is pivotally supported in the housing 5 and includes a laminated magnetic clapper 101 and an actuating member 103.

The separate thermal trip device 16 in each pole unit includes a bimetal element 105 welded to the conducting strip 25. The upper end of the bimetal element 105 includes an adjusting screw 107 threaded therein.

When the circuit breaker is in the latched position as seen in FIG. 1, the springs 67 operate through the toggle link 55 and pivot 65 to bias the cradle 57 in a clockwise direction about the pivot point 59. Clockwise movement of the cradle member 57 is restrained by the latch mechanism 15.

The circuit breaker is shown in the closed and reset position in FIG. 1. Upon occurrence of an overload current above a predetermined value in any of the pole units, the clapper 101 is attracted toward the associated pole piece 95 whereupon the armature structure 97 pivots in a clockwise direction closing the air gap between the pole piece 95 and clapper 101 and pivoting the armature actuating member 103 in a clockwise direction to release the latch mechanism 15. The force of the operating springs 67 upon the knee pin 61 is transmitted through the upper toggle link 53 to cause the cradle member 57 to rotate in a clockwise direction about the point 59. Continued rotation of the cradle member moves the upper toggle pin 65 to the right of the line of action of the operating springs 67, causing collapse of the toggle linkage 53, 55 to rotate the carriage 32 and the attached crossbar 35 in a counterclockwise direction and move all three upper contact arms 20 in a counterclockwise direction to simultaneously open the contacts of the three pole units. During this movement, the handle 49 is moved to a TRIP position between the OFF and ON positions to provide a visual indication that the circuit breaker has been tripped. The circuit breaker mechanism must then be reset and latched before the circuit breaker can be manually operated after an automatic tripping operation.

With the circuit breaker in the closed and latched position as seen in FIG. 1, a low current overload condition will generate heat and cause the upper end of the bimetal member 105 to flex to the right as seen in FIG. 1. The adjusting screw 107 impinges on the armature actuating member 103 of the armature structure 97. This causes counterclockwise rotation of the trip bar 73 to initiate a tripping action and achieve automatic separation of the contacts in all three pole units as hereinbefore described with regard to a magnetic trip.

Figure 2:
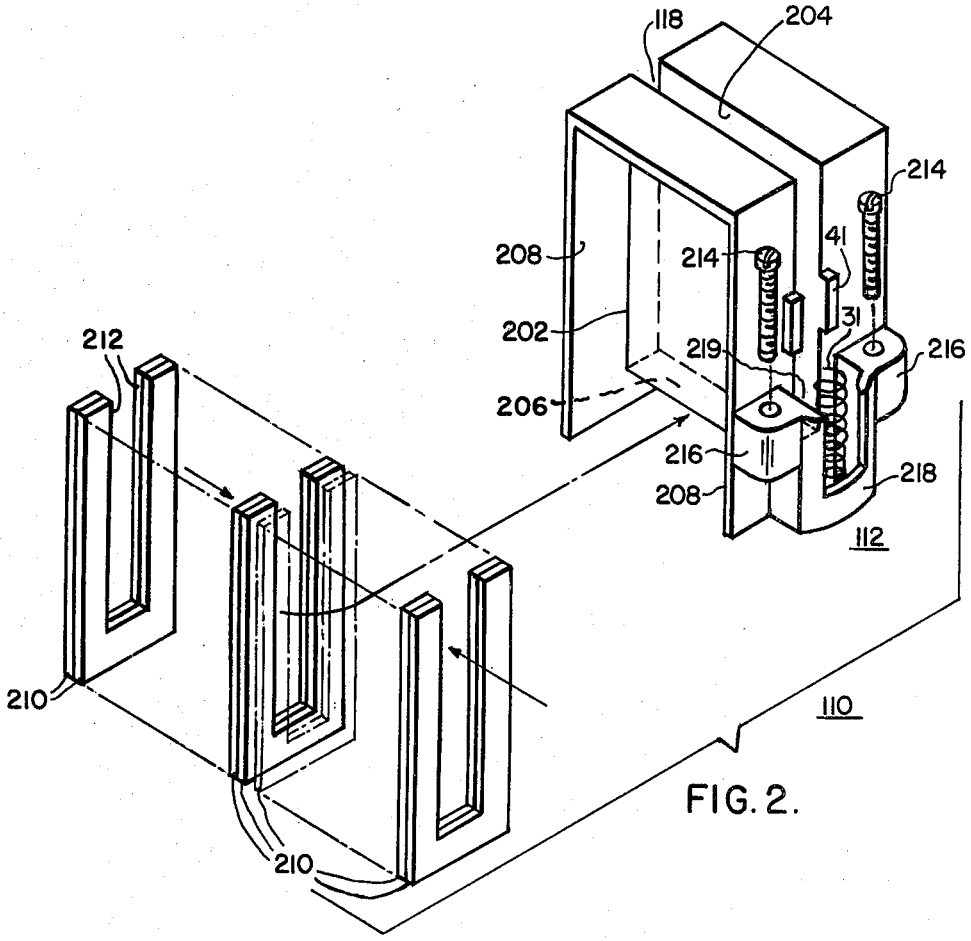
FIG. 2 is an exploded perspective view of the slotted magnetic drive device shown in FIG. 1.

The circuit breaker includes a slotted magnetic drive device 110, seen most clearly in FIG. 2. The magnetic drive device 110 includes a molded housing 112 having a slot 118 within which are disposed the upper and lower contact arms 20 and 22. The slot 118 is defined by a pair of side walls 202, 204 and a bottom wall 206. A pair of retaining walls 208 are formed on each end of the side walls 202, 204. The housing 112 is molded from glass polyester and includes material such as aluminum trihydrate which evolves an arc-extinguishing gas upon exposure to an intense electrical arc.

A plurality of laminations 210 of steel or other magnetic material are formed into a stack as shown in FIG. 2. The thickness of the stack is slightly greater than the distance between the retaining walls 208. Thus when the stack is press fitted into the housing 112 with the lamination legs 212 positioned on either side of the slot 118, the retaining walls 208 are flexed to produce an inward retaining force which presses the laminations 210 together. This eliminates the need for rivets or other retaining means which passed through the laminations of prior art magnetic drive devices.

The housing 112 is secured to the base 9 by a pair of bolts 214 inserted through lugs 216 molded into the housing 112. The two lugs 216 are joined by a slotted surface 218 to form a recess 219 for the spring 31, which provides contact pressure upon the lower contact arm 22. The stop, or limit member, 41, is molded into the housing 112 and cooperates with the pin 40 to limit the travel of the lower contact arm 22 when the breaker is in the open position.

Figure 4:
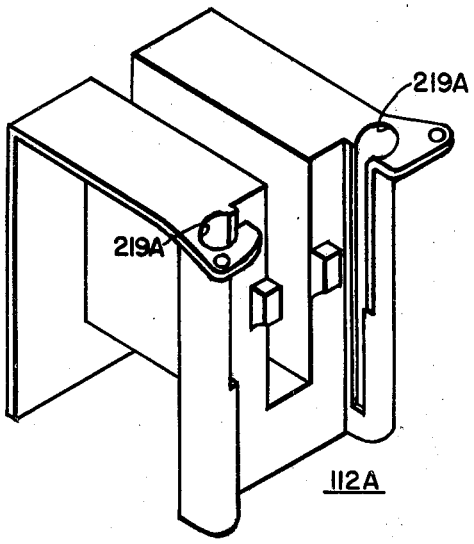
FIG. 4 is an alternative embodiment of the invention suitable for higher rating applications.
Figure 3:
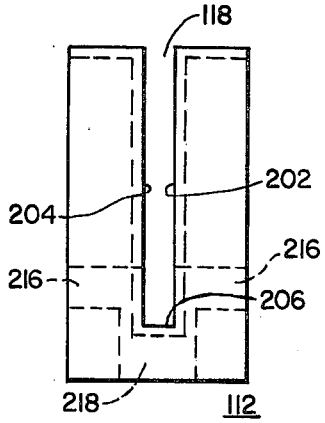
FIG. 3 is a end view of the magnetic drive device housing shown in FIG. 2.

FIG. 4 shows an alternative magnetic drive device housing 112A suitable for higher rating breakers such as disclosed in the aforementioned copending U.S. patent application Ser. No. 951,938. The housing 112A includes a pair of recesses 219A adapted to receive compression springs. A cross piece, not shown, then bridges the springs to support the lower contact arm 22 and provide contact pressure.

A bumper member 120 (FIG. 1) is provided to limit the travel of the upper contact arm 20 during current limiting operations as will be described hereinafter. The bumper member 120 is composed of shock absorbing material such as polyurethane or butyl plastic. This type of material has a very large mechanical hysteresis loop, thus absorbing a maximum amount of energy and minimizing rebound. A similar member 121 mounted to the base 9 is provided for the lower arm 22.

Under short circuit conditions, extremely high levels of overload current flow through the circuit breaker 3. The current flow through the conductor member 28 and lower contact arm 22 generates a large amount of magnetic flux in the slotted magnetic drive device 110. This flux and the current flow through the lower contact arm 22 produces a high electrodynamic force upon the lower contact arm 22, tending to drive the arm 22 from the closed position of FIG. 1 toward the bottom of the slot 118, as shown in dashed lines in FIG. 1. In addition, the current flow through the contact arms 20 and 22 in opposite directions generates a high electrodynamic repulsion force between the arms 20 and 22. This force builds up extremely rapidly upon occurrence of a short circuit condition, causing the upper contact arm 20 to pivot in a counterclockwise direction about the pin 30, acting against the tension force of the spring 36, from the closed position to the current limiting position shown in dashed lines in FIG. 1. The upper contact arm 20 is thus driven with great force into the bumper member 120, which is designed so as to minimize the amount of rebound of the upper contact arm 20. This rebound is undesirable since the established arc which has been extinguished by the arc extinguishing device 23 may restrike if the contacts 19 and 21 return in close proximity. The high-speed magnetic trip device 17 is therefore designed to operate the latch mechanism 15 to release the operating mechanism 13 before the arms 20 and 22 can reclose. As the operating mechanism 13 moves from the closed position to the tripped position, the carriage 32 rotates in a counterclockwise direction to raise the pivot point of the upper contact arm 20 before the tension spring 36 returns the upper contact arm 20 to the first position with respect to the carriage 32.

The initial high opening acceleration of the contact arms produces a high arc voltage resulting in extremely effective current limiting action. The combination of the high speed electromagnetic trip device and high speed operating mechanism assures that the contacts will remain separated to prevent re-establishment of the arc after it is extinguished.

Separation of the arms 20 and 22 forms an arc between the contacts 19 and 21, causing adjacent surfaces of the housing 112 to evolve a quantity of gas which aids electrodynamic forces on the arc tending to propel the arc outward into the extinguishing device 23. The gas also helps to cool the arc and the ionization column which remains following arc extinction at current zero, thus helping to prevent arc re-ignition.

A magnetic drive device as disclosed herein provides electrical performance equal to or better than the prior art. In addition, by reducing assembly effort and cost it helps to provide a current limiting circuit breaker having a lower manufacturing cost.

We claim:

1. Current limiting circuit interrupter apparatus, comprising:

a case;

separable contacts disposed in said case;

a movable contact arm supporting one of said contacts;

an operating mechanism connected to said movable contact arm for operating said movable contact arm between open and closed positions during conditions of normal current flow through said apparatus; and a slotted magnetic drive device for generating electrodynamic opening force on said movable contact arm, comprising an insulating housing and a stack of U-shaped laminations of magnetic material each having a pair of legs connected by a bight portion;

said housing comprising a pair of spaced parallel insulating side walls parallel to the plane of movement of said contact arm and disposed on either side thereof, and a plurality of resilient retaining walls parallel to said laminations perpendicular to said side walls and outwardly extending at each end therefrom, the distance between said retaining walls being slightly less than the thickness of said lamination stack;

said lamination stack being press fitted into said housing between said retaining walls and positioned with respect to said housing such that said laminations are parallel to the retaining walls, said side walls are between the legs of each of said laminations, and said retaining walls are flexed to produce a force compressing said lamination stick.

2. Apparatus as recited in claim 1 wherein said housing comprises a bottom wall perpendicular to said retaining walls and said side walls and connecting said side walls, said lamination stack being positioned in said housing so that the inner edge of the bight portion of said U-shaped laminations is positioned against said bottom wall on the opposite side of said bottom wall from said contact arm.

3. Apparatus as recited in claim 2 comprising means securing said housing to said case, said housing being so positioned with respect to said case such that the bight portions of said U-shaped laminations are captured between said bottom wall and said case.

4. Apparatus as recited in claims 1, 2, or 3 comprising a compression spring and a spring-receiving recess formed in said housing, said contact arm compressing said spring to provide contact pressure when said contacts are in the closed circuit position.

5. Apparatus as recited in claim 4 comprising a pin inserted through said contact arm and a limit member formed in said housing, said compression spring urging said contact arm in a direction toward the other of said contacts, said pin engaging said limit member when said contacts are in an open position to limit travel of said contact arm in said direction.

6. Apparatus as recited in claim 1 wherein said housing comprises a surface composed of gas liberating material, said housing and said contacts being so positioned that said surface is exposed to an arc established between said contacts upon separation thereof, whereby gas is evolved from said surface to aid in arc extinction.

* * * * *